US005833439A

United States Patent [19]

Du

[11] Patent Number: 5,833,439

[45] Date of Patent: Nov. 10, 1998

[54] SLIDE VALVE OF A GAS DRIVEN PUMP

[76] Inventor: Benjamin R. Du, 12 Morgan, Irvine, Calif. 92718

[21] Appl. No.: 917,626

[22] Filed: Aug. 22, 1997

Related U.S. Application Data

[62] Division of Ser. No. 552,852, Nov. 3, 1995, Pat. No. 5,664,940.

[51] Int. Cl.[6] ..... F04B 43/06

[52] U.S. Cl. ..... 417/393; 91/347

[58] Field of Search ..... 417/393, 397, 417/46; 91/347

[56] References Cited

U.S. PATENT DOCUMENTS

| | | | |
|---|---|---|---|
| 1,881,344 | 10/1932 | Apple . | |
| 2,452,933 | 11/1948 | Joppich et al. . | |
| 2,485,408 | 10/1949 | Pezzillo . | |
| 2,535,695 | 12/1950 | Pezzillo . | |
| 2,671,462 | 3/1954 | Grier . | |
| 2,761,078 | 8/1956 | McAdam . | |
| 2,873,684 | 2/1959 | Kaeding . | |
| 2,920,575 | 1/1960 | White et al. . | |
| 2,981,182 | 4/1961 | Dietrich . | |
| 2,993,449 | 7/1961 | Harland . | |
| 3,207,070 | 9/1965 | Klingler et al. . | |
| 3,268,271 | 8/1966 | Yackle . | |
| 3,699,846 | 10/1972 | Stomper . | |
| 3,719,436 | 3/1973 | McFarlin . | |
| 3,753,629 | 8/1973 | Jackson . | |
| 3,782,863 | 1/1974 | Rupp | 417/393 |
| 3,808,814 | 5/1974 | Macy, II . | |
| 3,813,191 | 5/1974 | Foster . | |
| 4,436,493 | 3/1984 | Credle, Jr. | 417/393 |
| 4,540,349 | 9/1985 | Du | 417/393 |
| 4,551,076 | 11/1985 | DuBois | 417/395 |
| 4,681,518 | 7/1987 | Credle, Jr. . | |
| 4,736,873 | 4/1988 | Patriquin . | |
| 4,828,465 | 5/1989 | Credle, Jr. . | |
| 4,923,168 | 5/1990 | Murata et al. . | |
| 5,002,469 | 3/1991 | Murata et al. . | |
| 5,470,209 | 11/1995 | Hartley et al. | 417/401 |
| 5,664,940 | 9/1997 | Du | 417/393 |

OTHER PUBLICATIONS

"Air Operated Diaphragm Pumps" by Aro.

*Primary Examiner*—Timothy Thorpe
*Assistant Examiner*—Cheryl J. Tyler
*Attorney, Agent, or Firm*—Stetina Brunda Garred & Brucker

[57] ABSTRACT

A gas driven pump has a housing, first and second cylinders disposed within the housing, and first and second interconnected pistons having product intake and product exhaust positions disposed within the first and second cylinders, respectively. A slide valve has first and second positions for alternately pressurizing one of the first and second cylinders and venting the other of the first and second cylinders. A linkage moves the slide valve between the first and second positions thereof in response to movement of the first and second pistons. Over-center construction of the linkage prevents stalling of the slide valve, so as to assure reliable operation of the gas driven pump. The slide valve comprises a slide for placing an inlet port in fluid communication with an alternating one of two pressure/vent ports such that the slide valve scrapes frost build up from the pressure/vent ports as it moves thereover, thereby further enhancing reliability of the gas driven pump.

5 Claims, 3 Drawing Sheets

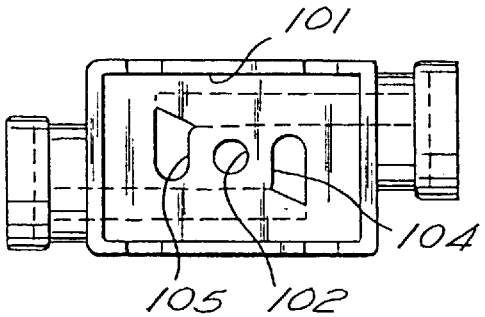
Fig. 7
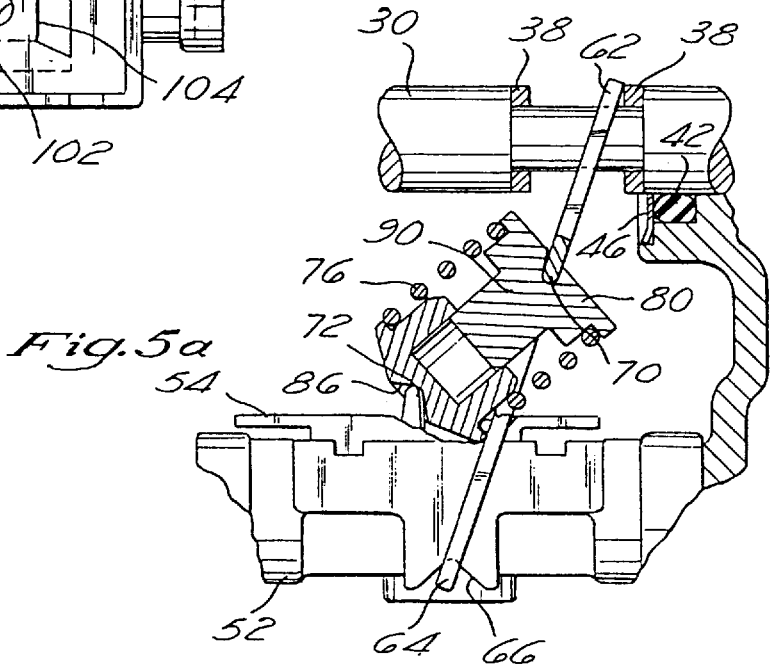
Fig. 5a
Fig. 8
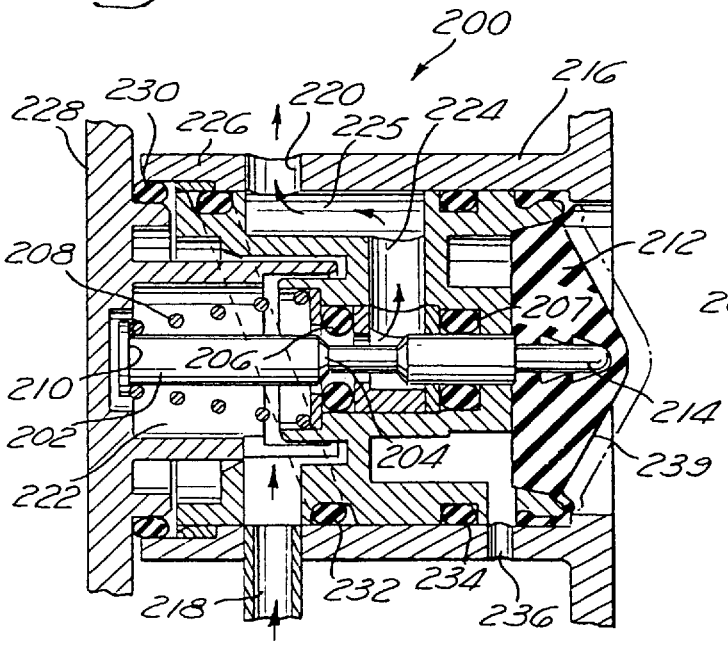
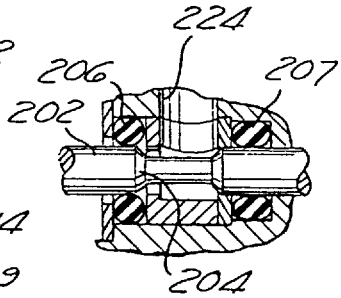
Fig. 8a

SLIDE VALVE OF A GAS DRIVEN PUMP

This application is a division, of application Ser. No. 08/552,852, filed Nov. 3, 1995, now U.S. Pat. No. 5,664, 940.

FIELD OF THE INVENTION

The present invention relates generally to pumps and more particularly to a gas driven pump for pumping viscous fluids such as condiments, e.g., mustard, ketchup, mayonnaise, etc., and having anti-stall features to enhance the reliability thereof.

BACKGROUND OF THE INVENTION

Gas driven pumps for pumping fluids such as beverage syrups are well known. Such gas driven pumps are commonly utilized in carbonated beverage fountains wherein the pump is powered via carbon dioxide so as to effect dispensing of the syrup and/or carbonated water comprising a beverage.

One example of such a gas driven pump is that disclosed in U.S. Pat. No. 4,540,349 issued on Sep. 10, 1985 to Du, the contents of which are hereby incorporated by reference. In that contemporary gas driven pump, two opposed pistons are mounted upon a common piston shaft for reciprocal movement thereof within a housing. Cavities complimentary to the pistons are alternately vented and pressurized to intake the pumped product into the pair of cylinders and to drive the pistons so as to pump the product.

A spool valve stem extends into the cavity being vented so that the piston performing an intake stroke moves the valve stem into the other cavity so as to effect alternating motion of the two pistons. A pair of axial passages and corresponding side openings in the valve stem provide fluid flow paths for venting and pressurizing the cavities. A valve body biased toward the cavity being vented includes a vent passage for alternately venting the cavities through side inlets. While one cavity vents, pressurized fluid flows into the other cavity through the corresponding side inlet and axial passage. The valve body moves with the valve stem until the biasing spring is in an unstable over/center position, where the bias reverses to urge the valve body toward the other cavity.

Although such contemporary gas driven pumps have proven generally suitable for their intended purposes, such gas driven pumps suffer from inherent deficiencies which detract from their overall performance and utility. More particularly, such contemporary gas driven pumps are subject to stalling wherein the valve mechanism for effecting alternating pressurization and venting of the cylinders sticks, and consequently does not continue the cyclic pressurization/venting process.

The occurrence of such stalling is often exacerbated by the use of a pressurized gas, such as carbon dioxide, wherein expansion of the pressurized gas into the cylinders and/or body of the air driven pump results in substantially reduced temperatures at the inlet orifices of the gas driven pump. Such reduced temperatures are frequently accompanied by frost buildup at the inlet orifices which impedes movement of the valve mechanism, thereby resulting in stalling of the gas driven pump.

A further deficiency of such contemporary gas driven pumps is their inability to sense depletion of the pump product and automatically shut off when such depletion is sensed. Rather, such contemporary gas driven pumps continue attempting to pump the pumped product even after the supply of pumped product has been deleted.

Prolonged operation of a gas driven pump subsequent to depletion of the pumped product may result in excessive wear thereto. The pumped product provides a degree of lubrication and cooling to the gas driven pump. As such, it is undesirable to operate gas driven pumps for a prolonged period of time subsequent to deletion of the pumped product.

As such, it is beneficial to provide a gas driven pump which is not substantially subject to stalling and which more particularly inhibits the buildup of frost so as to prevent sticking of the valve mechanism. It is also beneficial to provide a gas driven pump which automatically shuts off when depletion of the pumped product is sensed.

SUMMARY OF THE INVENTION

The present invention specifically addresses and alleviates the above mentioned deficiencies associated with the prior art. More particularly, the present invention comprises a gas driven pump having a housing; first and second cylinders disposed within the housing; first and second interconnected pistons having product intake and product exhaust positions disposed within the first and second cylinders, respectively; a slide valve for alternately pressurizing one of the pistons and venting the other of the pistons; and a linkage for moving the slide valve between the first and second positions thereof in response to movement of the first and second pistons.

When the first piston is in the product intake position thereof, i.e., having just expanded the volume of the cylinder so as to draw the pumped product into the cylinder, then the second piston is in the product exhaust position thereof, i.e., having just contracted the volume of the cylinder so as to force the pumped product therefrom, and the slide valve is positioned so as to effect pressurization of the first piston and venting of the second piston, so as to cause the first piston to move to the product exhaust position thereof and the second position to move to the product intake position thereof. Similarly, when the first piston is in the product exhaust position thereof, the second piston is in the product intake position thereof and the slide valve positioned so as to effect pressurization of the second piston and venting of the first piston, so as to cause the first piston to move to the product intake position thereof and the second piston to move to the product exhaust position thereof. Such movement of the first and second pistons and the slide repeat cyclicly so as to effect pumping of the product through the first and second cylinders.

The first and second pistons are preferably interconnected via a shaft extending therebetween such that the first and second pistons, and preferably the shaft, move along a common axis.

A flexible diaphragm is preferably utilized to provide a seal between the first and second pistons and the first and second cylinders, respectively. The flexible diaphragm thus separates the gas pressurized portion of the cylinder from the product pumping side thereof so as to prevent intermixing of the pressurizing gas and the pumped product.

The slide valve comprises a pressure inlet port, two exhaust/inlet ports, and a slide for placing the inlet port in fluid communication with an alternating one of the two exhaust/inlet ports.

The linkage comprises an over-center linkage for assuring positive movement of the slide when the first and second pistons move so as to prevent stalling of the pump. The over-center linkage thus causes the slide to move to the appropriate position so as to valve the intake and vent ports in a manner which effects continued operation of the gas operated pump of the present invention. Stalling is prevented by eliminating the likelihood of the slide coming to rest at an intermediate or non-operational position such that the pistons are not caused to move to the next stage or cycle of their operation.

The slide is always urged into a position wherein the intake and vent ports effect pressurization of the pistons so as to assure continued motion thereof. Movement of the slide occurs as a yoke passes over-center, thereby substantially changing the angle-of-attack of a compression spring which is thus placed in an orientation having sufficient leverage to quickly and forceably move the slide to the desired position. The angle-of-attack of the compression spring is rapidly changed from one wherein the spring compresses and does not exert a force tending to move the slide to a position wherein the spring is free to expand and capable of moving the slide while exerting favorable leverage thereupon. As such, the gas operated pump of the present invention continues to operate as long as pressurized gas is provided.

The over-center linkage comprises a compression spring which is first compressed as the pistons move from one position to another and then expands so as to effect positive movement of the slide. Such construction thus facilitates reliable operation of a slide valve driven by a shaft having a comparatively short stroke. Thus, the valving action of the slide is independent of the pistons travel, requiring only movement about the over-center position thereof so as to effect proper operation.

Additionally, the slide valve is configured so as not to be susceptible to stalling due to frost buildup. The slide scrapes frost buildup away from the exhaust/inlet ports of the slide valve as the slide moves between the two alternate positions thereof. Thus, the frost which inherently tends to accumulate at the exhaust/inlet ports is not permitted to build up to a point wherein it prevents further motion of the valve, thereby causing the gas operated pump to stall. As such, the gas operated pump of the present invention is not substantially susceptible to the undesirable effects of such frost buildup and the reliability thereof is substantially enhanced.

An optional automatic shut-off valve senses depletion of the pumped product and shuts off the gas driven pump of the present invention when such depletion is sensed. Since the gas driven pump of the present invention receives pumped product from a bag and box container, depletion of the pumped product results in the formation of a vacuum at the pumped product inlet to the gas driven pump. Such vacuum acts upon a diaphragm to effect closure of the gas supply spring biased valve for the gas driven pump, thereby halting its operation.

Thus, operation of the gas driven pump of the present invention is interrupted in the event that the pumped product supply is depleted. Such interruption of the operation of the gas driven pump of the present invention prevents excessive wear, particularly as may be caused by operation of the gas driven pump while lacking the cooling and lubrication effects of the pumped product.

These, as well as other advantages of the present invention will be more apparent from the following description and drawings. It is understood that the changes in the specific structure shown and described may be made within the scope of the claims without departing from the spirit of the invention.

BRIEF DESCRIPTION OF THE DRAWINGS

FIG. 5*a* is a sectional view of the shaft, over-center linkage, and slide valve of FIG. 5;

FIG. 7 is an enlarged top view of the valve body of FIGS. 1–3, 5, and 6;

FIG. 8 is an enlarged cross-sectional view of the automatic shut-off valve of FIG. 1; and FIG. 8*a* is an enlarged cross-sectional view of the valve and valve seat of the automatic shut-off valve of FIG. 8.

DETAILED DESCRIPTION OF THE PREFERRED EMBODIMENT

Figure 1:
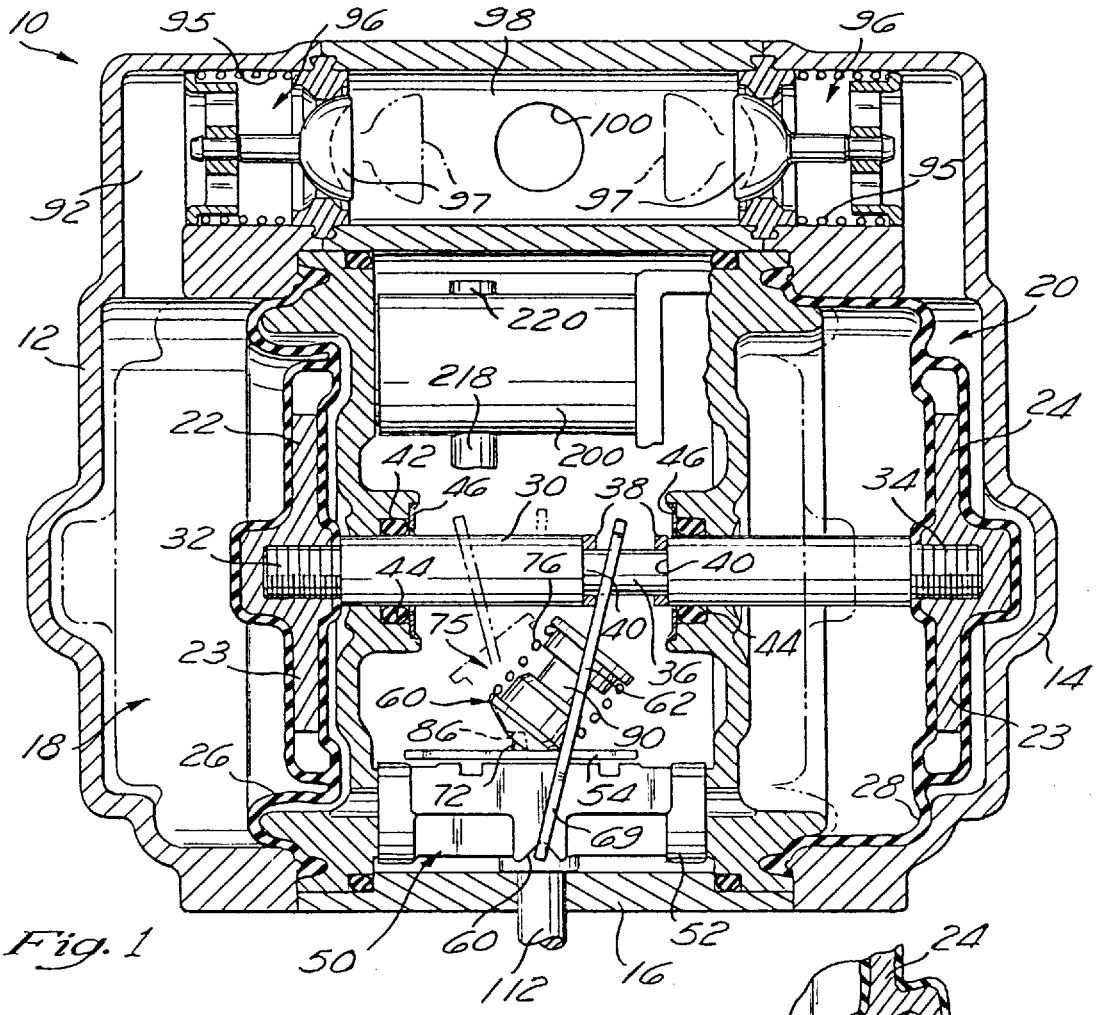
FIG. 1 is a cross-sectional front view of the gas driven viscous fluid pump of the present invention showing the left or first piston in the product intake position thereof, wherein carbon dioxide is vented from the first cylinder, and showing the second cylinder in the product exhaust position thereof, wherein carbon dioxide pressurizes the second cylinder.

The detailed description set forth below in connection with appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

The gas operated viscous fluid pump of the present invention is illustrated in FIGS. 1 through 8*a* of the drawings which depict a presently preferred embodiment of the invention. Referring now to FIGS. 1 through 4, the gas operated pump generally comprises a housing 10, which is preferably comprised of first 12, second 14, and third 16 housing sections. A first cylinder 18 is defined within the first housing section 12 and a second cylinder 20 is defined within the second housing section 14. A first piston 22 is movably disposed within the first cylinder 18 and a second piston 24 is similarly movably disposed within the second cylinder. A diaphragm 26 seals the first piston 22 to the first cylinder 18 and a diaphragm 28 seals the second piston 24 to the second cylinder 20. The first 22 and second 24 pistons are interconnected via a shaft 30 attached thereto and disposed therebetween.

The shaft 30 interconnects the first 22 and second 24 pistons such that they move together along a common axis within the first 18 and second 20 cylinders, respectively. The shaft 30 has a first threaded end 32 attaching it to the first piston 22 and a second threaded end 34 attaching it to the second piston 24. A section of reduced diameter 36 is formed at approximately the mid point of the shaft 30. Resilient washers 38 are formed at the shoulders 40 of the section of reduced diameter upon the shaft 30. O-rings 42 held within grooves 44 via retainers 46 facilitate translation or sliding movement of the shaft 30 within each of the first 18 and second 20 cylinders.

Each piston 22 or 24 and its attached diaphragm 26 or 28, respectively, divide each cylinder 18 and 20, respectively, in to pumped product and carbon dioxide pressurizable portions. The diaphragms, 26 and 28 assure that the pumped product and carbon dioxide remain separated and thus do not intermix.

Each of the first 22 and second 24 pistons preferably comprises a rigid member 23 about which the first 26 and second 28 resilient diaphragm is continuously formed so as to provide a covering thereover.

A slide valve 50 generally comprises a slide valve body 52 and a slide 54 and is disposed within cavity 17 formed within the third housing section 16.

An over-center linkage 60 facilitates movement of the slide 54 of the slide valve assembly 50 in response to motion of the shaft 30 and the first 22 and second 24 pistons attached thereto.

Figure 2:
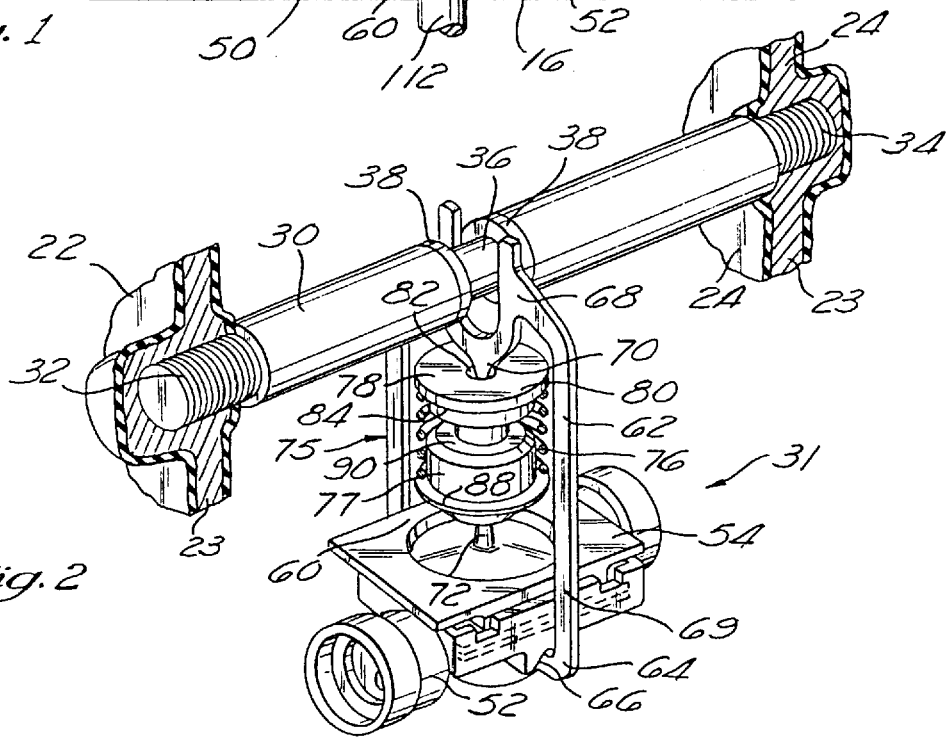
FIG. 2 is an enlarged perspective view of the shaft interconnecting the first and second pistons, the slide valve assembly, and the over-center linkage connecting the shaft and the slide valve assembly.
Figure 4:
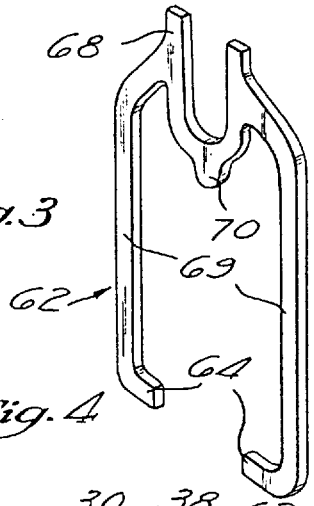
FIG. 4 is a perspective view of the yoke of the over-center linkage of FIG. 2.

With particular attention to FIGS. 2 and 4, the over-center linkage more particularly comprises a yoke 62 formed in a frame like configuration and pivoting about a lower ends 64 thereof disposed within a V-grooves 66 of the slide valve body 52. The upper end of the yoke 62 is configured as a U-member 68 which receives the section of reduced diameter 36 of the shaft 30 such that the yoke pivots about the V-groove 66 of the slide valve body 52 in response to movement of the slide. Thus, as the slide 30 moves back and forth laterally, each of the resilient washers 38 of the shaft 30 alternately abut the yoke 62 and urge it back and forth in a pivoting motion about the V-grooves 66. Elongate members 69 interconnect the U-member 68 and the lower ends 64 of the yoke 62.

A first post 70 extends downwardly from the U-member 68 and a second post 72 extends upwardly from the slide 54 so as to capture spring assembly 75 therebetween. The spring assembly 75 comprises compression spring 76, sleeve member 77, and insert member 78. The insert member comprises a shoulder 80 having an aperture 82 formed therein for receiving the post 70 of the U-member 68 and has a shoulder 84 against which the upper end of the compression spring 76 abuts. The sleeve member 77 likewise comprises an aperture 86 which receives the upwardly extending post 72 of the slide 54 and a shoulder 88 against which the lower end of the compression spring 76 abuts. The insert member further comprises a downwardly extending insert 90 received within a bore 92 formed in the sleeve member 77. Thus, the compression spring 76 urges the insert member 78 and the sleeve member 77 away from one another. The insert member 78 and the sleeve member 77 maintain desirable positioning of the compression spring 76 within the yoke 62 such that the compression spring 76 urges the slide 54 downward against the slide valve body 52.

With particular reference to FIG. 1, the gas driven pump of the present invention further comprises first pumped product outlet port 92 and second pump product outlet port 94, each of the first 92 and second 94 pumped product outlet ports providing fluid communication to outlet check valves 96 which facilitate flow of the pumped product from the first 92 and second 94 outlet ports to a common outlet manifold 98 from which the pumped product flows through the common outlet port 100 of the gas driven pump. Each outlet check valve 96 comprises a valve member 97 and a spring 95.

The gas driven pump of the present invention further comprises similarly configured inlet check valves, first and second product inlet ports, a common inlet manifold, and a common inlet port (all not shown). The inlet check valves are, similar to the outlet check values 97 and are of course, reversed in direction from that of the outlet check valves 97, so as to facilitate flow of the pumped product into the cylinders 18 and 20.

Figure 3:
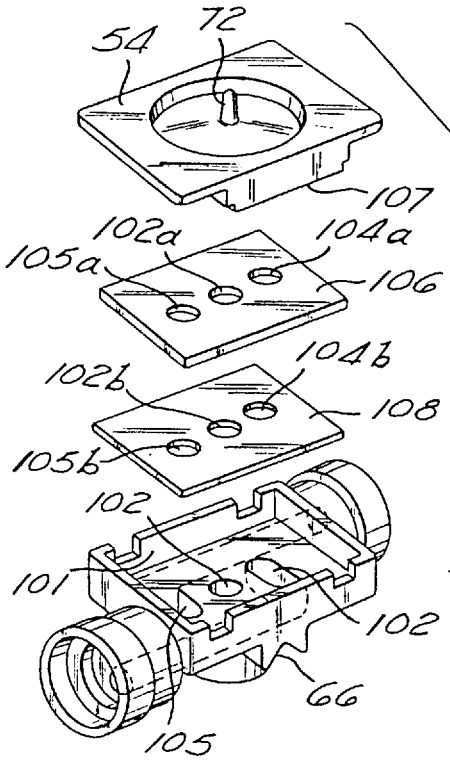
FIG. 3 is an exploded perspective view of the slide valve assembly of FIG. 2.

With particular reference to FIG. 3, the slide valve 50 further comprises a recess 101 formed within the slide valve body 52 and having an exhaust port 102 and two pressure/vent ports 104 and 105 formed therein. The exhaust port 102 extends downwardly from the cutout 100 to the V-groove 66. The exhaust port 102 provides fluid communication from alternate ones of the first 18 and second 20 cylinders to outside of the gas driven pump such that carbon dioxide is exhausted from each of the cylinders 18 and 20 on the product intake cycle thereof.

Each pressure/vent ports 104 and 105 extends downwardly, longitudinally past outlet port 102, and outboard to its respective end of the slide valve body 52. Thus, the left pressure/vent port 105 extends past the exhaust port 102 and to the right thereof while the right pressure/vent port 104 similarly extends past the exhaust port 102 and to the left thereof.

Metal plate 106 having exhaust port aperture 102*a* and pressure/vent port apertures 104*a* and 105*a* formed therein captures resilient gasket 108 having pressure inlet port aperture 102*b* and pressure/vent port apertures 104*b* and 105*b* formed therein intermediate itself and slide valve body 52.

The slide 54 is preferably comprised of TEFLON, DELRON, or a combination thereof so as to reduce friction during reciprocating translation of the slide 54 upon the upper-surface of the plate 106.

An automatic shut-off valve 200 senses the depletion of the pumped product and automatically shuts off the gas driven pump of the present invention when such depletion occurs. Thus, excessive wear to the gas driven pump is prevented.

With reference to FIGS. 8 and 8*a*, the automatic shut-off valve 200 comprises a valve spindle 202 having a valve surface 204 formed thereon for contacting an O-ring or valve seat 206. The valve spindle 202 is biased in an opened position by spring 208 which abuts head or abuttment surface 210 formed thereon. The opposite end of the valve spindle 202 from which the abuttment surface 210 is formed attaches to a diaphragm 212, preferably via barbs 214, so as to prevent inadvertent detachment thereof.

The automatic shut-off valve 200 is formed within a housing 216 having a carbon dioxide inlet 218 which receives carbon dioxide from the pressurized carbon dioxide source exterior to the gas driven pump and also has a carbon dioxide outlet 220 which exhausts carbon dioxide from the automatic shut-off valve to the interior 17 of the gas driven pump of the present invention, thus facilitating pressurization of the interior 17 of the gas driven pump with carbon dioxide so as to effect operation of the gas driven pump.

When the automatic shut-off valve 200 is in the opened position thereof, carbon dioxide is communicated from the carbon dioxide inlet port 218 to the spring bore 222, through the valve comprised of the valve surface 204 and valve seat 206, through interior passages 224 and 225 and out through exhaust port 220 into the interior 17 of the gas driven pump.

The automatic shut-off valve is preferably configured to have a housing 216 comprised of separable first 226 and second 228 portions thereof such that the housing 216 can be opened to facilitate maintenance of the automatic shut-off valve 200. O-ring seal 230 seals the first 226 and second 228 housing portions together to prevent pressurized carbon dioxide from escaping therefrom. Similarly, O-rings 232 and 234 provide additional seals between the pressurized carbon dioxide and the interior 17 of the gas driven pump. Vent 236 assures that the inside surface 238 of the diaphragm 212 is at the same pressure as the interior 17 of the gas driven pump. O-ring 207 seals the movable valve shaft 202 so as to prevent leakage of pressurized carbon dioxide into the interior 17 of the gas driven pump.

In operation, the automatic shut-off valve senses depletion of the pumped product when a vacuum, i.e., pressure substantially lower than that which is present prior to depletion of the pumped product, begins to form at the outer surface 239 of the diaphragm 212, which is in fluid communication with the pumped product inlet (not shown). Thus, as long as the supply of pumped product is maintained, spring 208 maintains the valve spindle 202 in its left-most or opened position. However, when the pumped product source is depleted, a vacuum begins to form in the pumped product line as the gas driven pump attempts to pump further product from the emptied bag and box container. Thus, a reduced pressure is applied to the outer surface 239 of the diaphragm 212 causing the diaphragm 212 to move to the right against the urging of spring 208. As the diaphragm 212 moves to the right, the valve spindle 202 moves along therewith, thus causing the valve surface 204 thereof to contact the valve seat 206, thereby closing the automatic shut-off valve and interrupting the flow of carbon dioxide therethrough. Such interruption of the flow of carbon dioxide halts operation of the gas driven pump of the present invention.

Having thus described the structure of the gas driven high viscosity fluid pump, it may be beneficial to discuss the operation thereof. The operation of the gas driven pump is illustrated in FIGS. 5 and 6 which illustrate the two extreme pistons between which the major components of the gas driven pump alternate during the operation thereof.

Figure 5:
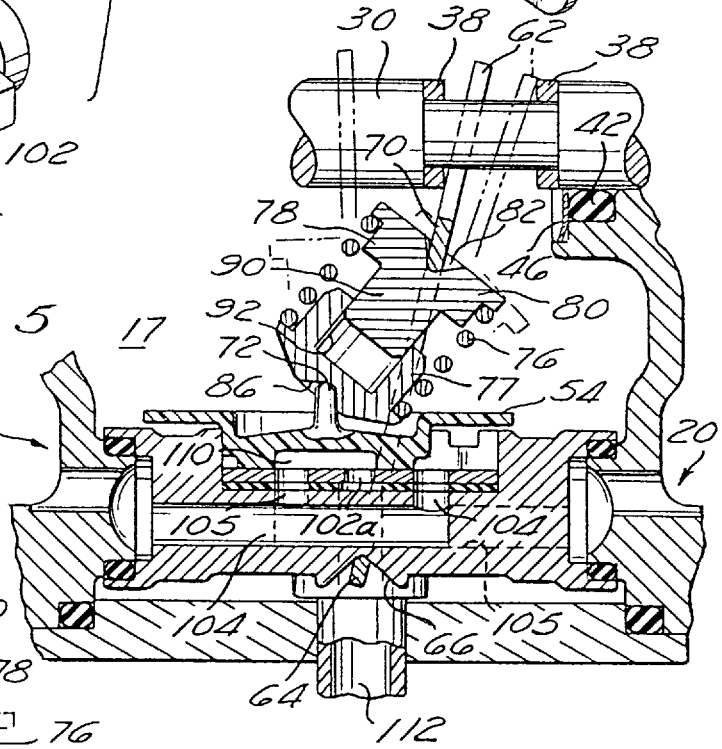
FIG. 5 is an enlarged cross-sectional fragmentary view of the shaft, over-center linkage, and slide valve illustrating pressurization of the first cylinder with carbon dioxide and venting of carbon dioxide from the second cylinder.
Figure 6:
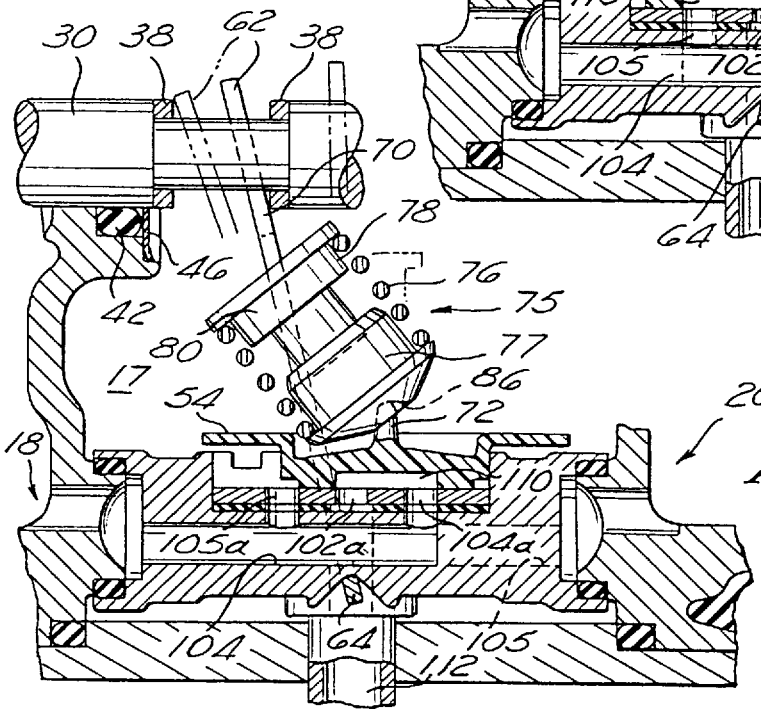
FIG. 6 is an enlarged cross-sectional fragmentary view of the shaft, linkage, and slide valve of FIG. 5, illustrating venting of carbon dioxide from the first cylinder and pressurization of the second cylinder with carbon dioxide.

With particular reference to FIG. 5, the shaft 30 is positioned such that the first piston 22 is in the product intake position (pressurized carbon dioxide having been vented from the first cylinder 18) and the second piston 24 is in the product exhaust position (pressurized carbon dioxide having been applied to the second cylinder 20). The over-center linkage 60 is pivoted toward the second cylinder 20, i.e., both the yoke 62 and the compression spring assembly 76 are pivoted to the right. The slide 54 is thus urged toward the first cylinder 18 such that cutout 110 formed in the lower surface of the slide 54 forms a continuous fluid passage with the carbon dioxide outlet 112, which exhausts to atmosphere, and the second pressure/vent port 105 so as to facilitate venting of the second cylinder 20.

Pressurization of the first cylinder 18 is effected since the first pressure/vent port 104 is in fluid communication with the pressurized interior 17 of the gas driven pump. Pressurization of the first cylinder 18 causes the first piston 22 to move from its product intake position to the product exhaust position thereof, i.e., to move to the left.

Thus, as the slide 54 facilitates venting of the second cylinder 20 to the atmosphere via the pressure/vent port 105 and the outlet 112, the slide 54 simultaneously facilitates pressurization of the first cylinder 18 via pressure/vent port 104 so as to effect the product exhaust stroke of the first piston 22.

Thus, the configuration illustrated in FIG. 5, wherein the first 22 and second 24 pistons are at their rightmost position causes the slide valve assembly 31 to be positioned so as to allow pressurized carbon dioxide to move the pistons to their leftmost position.

Referring to FIG. 6, with the shaft 30 disposed at its leftmost position, the first piston 22 is in the product exhaust position (pressurized carbon dioxide having been applied to the first cylinder 18) and the second piston 24 is in the product intake position (pressurized carbon dioxide having been vented from the second cylinder 20). The over-center linkage 60 is pivoted toward the first cylinder 18, i.e., both the yoke 62 and the compression spring 76 are pivoted to the left. The slide 54 is urged toward the second cylinder 20 such that the cutout 110 formed in the lower surface of the slide 54 formes a continuous passage with the carbon dioxide outlet 112 and pressure/vent port 104 so as to effect venting of the first cylinder 18. The second pressure/vent port 105 is in fluid communication with the interior 17 of the gas driven pump so as to facilitate pressurization of the second cylinder 20 to cause the second piston 24 to move from its product intake position to the product exhaust position thereof, i.e., to move to the right.

Thus, as the slide 54 facilitates venting of the first cylinder 18 to the atmosphere via the second pressure/vent port 104 and the outlet 112, the slide 54 simultaneously facilitates pressurization of the second cylinder 20 so as to effect the product exhaust stroke of the second piston 24.

Thus, the configuration illustrated in FIG. 6, wherein the first 22 and second 24 pistons are in their leftmost position causes the slide valve 31 to be positioned so as to allow pressurized carbon dioxide to move the pistons to their rightmost position.

As such, as long as a constant supply of pressurized carbon dioxide is provided at inlet port 112, the first 22 and second 24 pistons are caused to oscillate between the left most and right most positions thereof.

The over-center nature of the linkage 60 presents stalling of the gas driven pump of the present invention by assuring positive activation of the slide valve 50. As the shaft 30 travels from one position, to the other position thereof, the compression spring 76 is compressed as the yoke 62 urges the insert member 78 toward the sleeve member 77. Once the yoke 62 passes over its centered or vertical position, the compression spring 76 is oriented so as to favorably apply leverage to the slide 54 and expands so as to forcibly urge the slide 54 into a new position. Thus, the angle-of-attack of the compression spring 76 relative to the slide 54 varies as the yoke 62 moves from one position to another. The angle-of-attack provides favorable leverage for the compression spring 76 to move the slide 54 just after the yoke passes over-center.

As those skilled in the art will appreciate, the force applied by the compression spring 76 to the slide 54 is dependent upon the angle-of-attack. The more closely to parallel to the desired direction of movement that the force is applied, the greater the amount of the force applied that is actually utilized to effect such movement.

Stalling is inhibited since when the yoke 62 is at its centered position, its compression spring 76 is compressed and requires very little further movement of the yoke 62 to facilitate forceful expansion thereof, thereby moving in the slide 54 to a position which effects further cycling of the pistons 22 and 24.

Frost buildup at the first 104*a* and second 105*a* apertures or openings of the pressure/vent ports is prevented by the constant scrapping by the lower surface 107 of the slide 54 thereover, thus preventing stalling caused by such frost buildup and substantially improving the reliability of the gas driven pump of the present invention.

It is understood that the exemplary gas driven pump described herein and shown in the drawings represents only a presently preferred embodiment of the invention. Indeed, various modifications and additions maybe made to such embodiment without departing from the spirit and scope of the invention. For example, the pistons and cylinders need not be generally cylindrical in configuration, but rather may be of any desire shape and/or configuration. Additionally, various means are contemplated for mechanically interconnecting the two pistons. Thus, these and other modifications and additions may be obvious to those skilled in the art and may be implemented to adapt the present invention for use in a variety of different applications.

What is claimed is:

1. A gas driven pump comprising:

a) a housing;

b) first and second cylinders disposed within said housing;

c) first and second interconnected pistons movable between product intake and product exhaust positions and disposed within said first and second cylinders, respectively;

d) a slide valve movable between first and second positions for alternately pressurizing one of said first and second cylinders with a gas and venting the gas from the other of said first and second cylinders, said slide valve comprising;

i) a pressure inlet port;

ii) two pressure/vent ports;

iii) a slide for placing the inlet port in fluid communication with an alternating one of the two pressure/vent ports; and iv) wherein the slide scrapes frost buildup from the pressure/vent ports as it moves thereover;

e) an over-center linkage for moving said slide valve between the first and second positions in response to movement of said first and second pistons and assuring positive movement of said slide valve when said first and second pistons move to prevent stalling of the pump, said over-center linkage comprising an insert member, a sleeve member into which a portion of said insert member is received, and a compression spring abutting insert member and said sleeve member so as to urge said insert member and said sleeve member away from one another; and f) wherein when said first piston is in the product intake position and said second piston is in the product exhaust position said slide valve is positioned so as to effect pressurization of said first cylinder and venting of said second cylinder so as to cause said first piston to move to the product exhaust position and the second piston to move to the product intake position, and when said first piston is in the product exhaust position and said second position is in the product intake position said slide valve is positioned so as to effect pressurization of said second cylinder and venting of said first cylinder so as to cause said first piston to move to the product intake position and said second piston to move to the product exhaust position, such movement of the first and second pistons and the slide valve repeating so as to effect pumping of a product through the first and second cylinders.

2. The gas driven pump as recited in claim 1 wherein said slide comprises at least one of TEFLON and DELRON.

3. The gas-driven pump as recited in claim 1 further comprising an automatic shut-off for halting operation thereof when depletion of the pumped product is sensed.

4. The gas-driven pump as recited in claim 3 wherein said automatic shut-off comprises an automatic shut-off valve for discontinuing flow of the pressurized gas.

5. The gas-driven pump as recited in claim 4 wherein said automatic shut-off valve comprises:

a) a conduit in pressure communication with a source of pumped product;

b) a diaphragm for sensing reduced pressure in said conduit;

c) a valve responsive to said diaphragm for controlling the flow of pressurized gas to said first and second cylinders; and d) wherein said diaphragm effects closing of said valve in response to sensing reduced pressure in said conduit.

* * * * *